United States Patent [19]

Bennett et al.

[11] Patent Number: 4,852,794

[45] Date of Patent: Aug. 1, 1989

[54] DIRECT MAIL SOLICITATION DEVICE AND METHOD FOR ASSEMBLY THEREOF

[75] Inventors: Stanley N. Bennett, Bridgeton, N.J.; James T. Perry, West Chester; Ronald D. Greene, Villanova, both of Pa.

[73] Assignee: Devon Dircet Marketing & Advertising, Inc., Malvern, Pa.

[21] Appl. No.: 236,806

[22] Filed: Aug. 26, 1988

[51] Int. Cl.[4] ..... B65D 27/04

[52] U.S. Cl. ..... 229/73; 229/71; 229/92.3; 229/92.8

[58] Field of Search ..... 229/72, 92.3, 92.7, 229/92.8, 71, 73

[56] References Cited

U.S. PATENT DOCUMENTS

| | | | |
|---|---|---|---|
| 1,874,796 | 8/1932 | Palm | 229/92.7 |
| 1,894,027 | 1/1933 | Deutschmeister | 229/92.7 |
| 1,951,144 | 3/1934 | Galter | 229/92.8 |
| 2,055,716 | 9/1936 | Berkowitz | 229/71 |
| 2,852,277 | 9/1958 | Robbins et al. | 229/71 |
| 3,321,127 | 5/1967 | Miller | 229/71 |
| 3,843,042 | 10/1974 | Mayne | 229/92.8 |
| 3,899,127 | 8/1975 | Melander | 229/71 |

FOREIGN PATENT DOCUMENTS

| | | | |
|---|---|---|---|
| 17253 | 4/1906 | United Kingdom | 229/92.8 |

*Primary Examiner*—Stephen Marcus
*Assistant Examiner*—Jes F. Pascua
*Attorney, Agent, or Firm*—Sughrue, Mion, Zinn, Macpeak & Seas

[57] ABSTRACT

A direct mail solicitation device includes an outer wrapper folded along one edge, open at one end, closed at the other end and having an adhesive coated flap extending along the other side edge thereof for sealing the wrapper along said other side edge. An elongated inner sheet, having first and second portions, is folded about a transverse fold line and disposed in said outer wrapper with the fold line adjacent the closed end of the outer wrapper with the end of at least one of said portions opposite the fold line disposed adjacent the open end of the outer wrapper. A reply envelope is disposed in said outer wrapper between said first and second portions of said inner sheet adjacent said fold line and is dimensioned relative to said outer wrapper to be frictionally compressed between the side edges of said outer wrapper when said flap is sealed to said wrapper thereby locking the reply envelope and the folded sheet within said outer wrapper. The method for assembling the device includes folding first and second portions of an elongated sheet about a traverse fold line, locating a reply envelope having a width greater than the width of said elongated sheet between said first and second portions adjacent said fold line, inserting said sheet and envelope into an outer wrapper which is folded along one side edge, opened at one end, closed at the other end and having an adhesive coated flap along the other side edge which is opened upon insertion of the sheet and envelope into the outer wrapper wherein the reply envelope has a width substantially equal to the width of the outer wrapper, and sealing the flap to the wrapper to compress the reply envelope between the side edges of the outer wrapper to frictionally lock the envelope in the wrapper to prevent accidental withdraw of the sheet from the open end of the outer wrapper.

6 Claims, 3 Drawing Sheets

FIG. 4
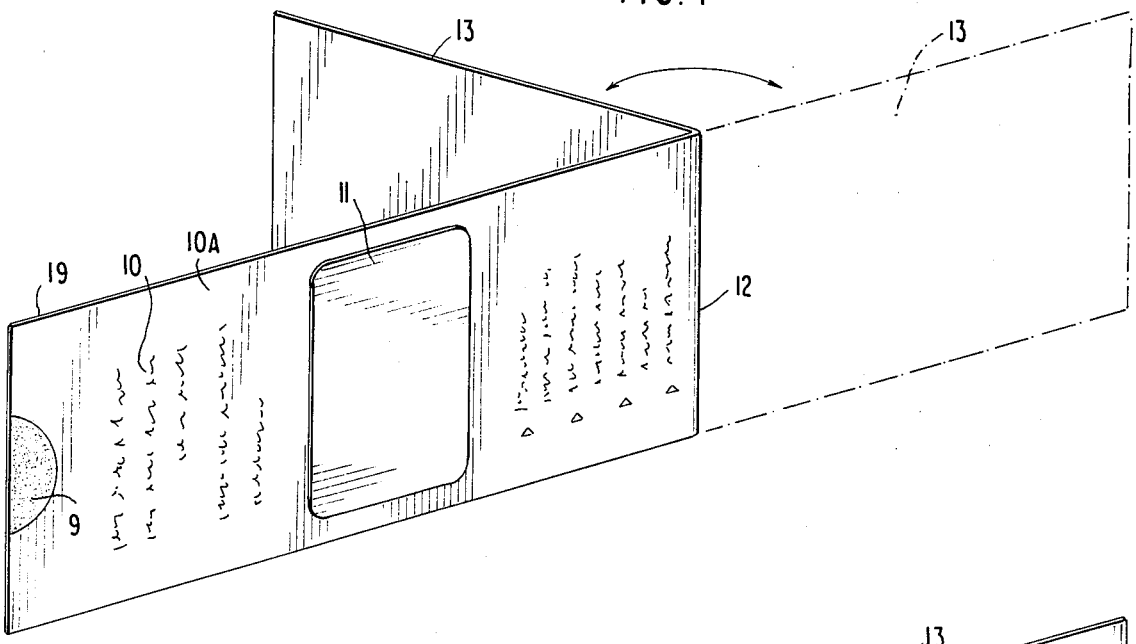
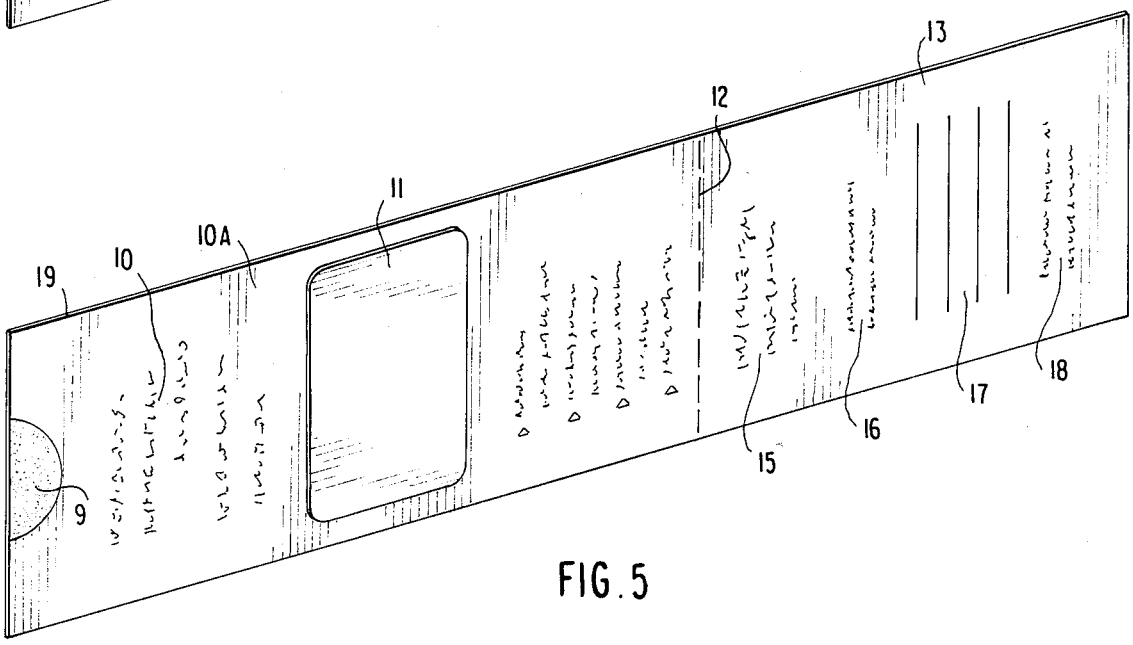
FIG. 5

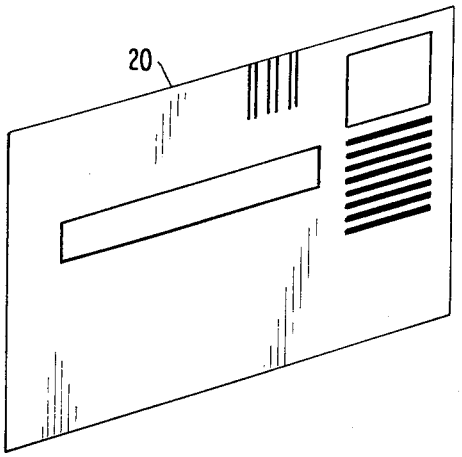
FIG.6
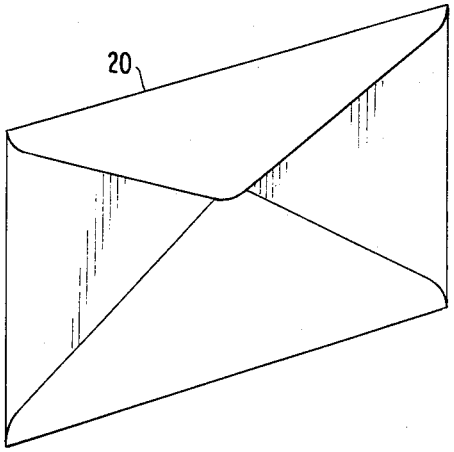
FIG.7
FIG.8
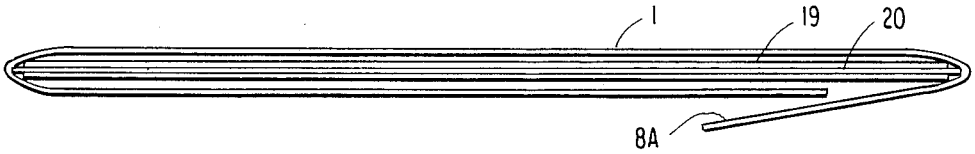
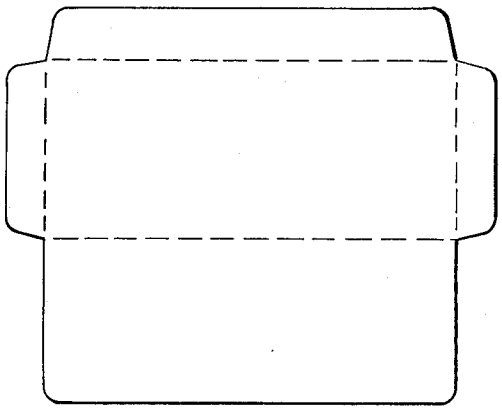
FIG.9

DIRECT MAIL SOLICITATION DEVICE AND METHOD FOR ASSEMBLY THEREOF

FIELD OF THE INVENTION

This invention relates to a direct mail solicitation device and method for assembly thereof. More particularly, this invention relates to a direct mail solicitation device which is designed to increase recipient order response by attracting the attention of the recipient and inducing the recipient to (a) interact with the functional design of the device, and (b) respond to the enclosed promotional offer by returning the detached order form in the supplied postage paid reply envelope.

BACKGROUND OF THE INVENTION

There are many types of direct mail solicitation devices, many of which are used for sending material through the U.S. Postal Service. Indeed, the use of direct mail solicitation devices as a means for offering products or services to the public has grown tremendously in the last several years. This proliferation of unsolicited offers for products or services by the advertising community to its target markets has created a high degree of apathy toward these packages by the recipients, with a corresponding decrease in order response.

It is therefore an object of the present invention to fulfill four basic requirements for a successful direct mail offer:

(1) provide a package that is cost efficient for direct mail campaigns;

(2) provide a package that complies with U.S. Postal Regulations;

(3) provide a package that will (a) capture the recipients interest. (b) stimulate the recipients to open the package, and (c) increase order response by involving the recipients in the package so that they can make an intelligent purchase decision; and (4) provide a package that is so easy to open that the recipient can open the package faster than the time it would take to discard it, considering that opening a traditional gum-sealed package can take longer to open than the time to discard it.

SUMMARY OF THE INVENTION

To accomplish the above objectives, the present invention provides a direct mail solicitation device comprising:

(A) an outer wrapper folded along one side edge, open at one end, closed at the other end and having an adhesive coated flap extending along another side edge thereof for sealing the wrapper along said another side edge;

(B) an elongated inner sheet, having first and second portions, folded about a transverse fold line and disposed in said outer wrapper with the fold line adjacent the closed end of the outer wrapper with the end of at least one of said portions opposite the fold line disposed adjacent the open end of the outer wrapper; and (C) a reply envelope in said outer wrapper between said first and second portions of said inner sheet adjacent said fold line and dimensioned relative to said outer wrapper to be frictionally compressed between the side edges of said outer wrapper when said flap is sealed to said wrapper thereby locking the reply envelope and the folded sheet within said outer wrapper.

In addition, the present invention provides a method for assembling a direct mail solicitation device comprising:

(A) folding first and second portions of an elongated sheet about a transverse fold line;

(B) locating a reply envelope having a width greater than the width of said elongated sheet between said first and second portions adjacent said fold line;

(C) inserting said sheet and envelope into an outer wrapper which is folded along one side edge, open at one end, closed at the other end and having an adhesive coated flap along another side edge which is open upon insertion of the sheet and reply envelope into the outer wrapper wherein the reply envelope has a width substantially equal to the width of the outer wrapper; and (D) sealing the flap to the wrapper to compress the reply envelope between the side edges of the outer wrapper to frictionally lock the envelope in the wrapper to prevent accidental withdrawal of the sheet from the open end of the outer wrapper.

The above and other objects features and advantages of the present invention will be more fully appreciated by those of ordinary skill in the art to which the invention pertains from the following detailed discussion and annexed drawings.

BRIEF DESCRIPTION OF THE DRAWINGS

FIG. 4 is a view of the inner sheet of the present invention in a partially folded position.

FIG. 5 is a view of the front surface of the inner sheet of the present invention in an unfolded position.

FIG. 6 is a view of the front surface of the reply envelope of the present invention.

FIG. 7 is a view of the rear surface of the reply envelope of the present invention.

FIG. 8 is an end view of the present invention.

FIG. 9 is an open, plan view of a conventional side seam envelope.

DETAILED DESCRIPTION OF THE INVENTION

Figure 1:
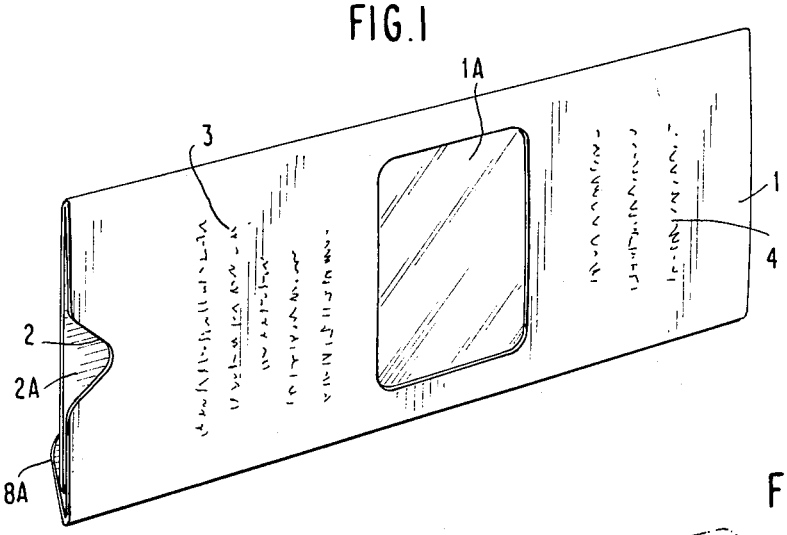
FIG. 1 is a view of the front surface of the preferred embodiment of the present invention.
Figure 2:
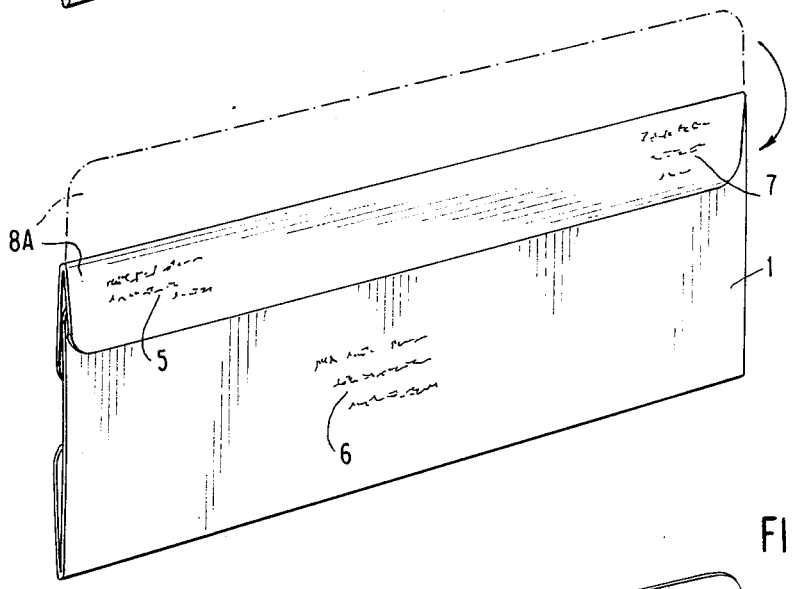
FIG. 2 is a view of the rear surface of the preferred embodiment of the present invention showing the hinged enclosing flap folded in the sealed or locking position.
Figure 3:
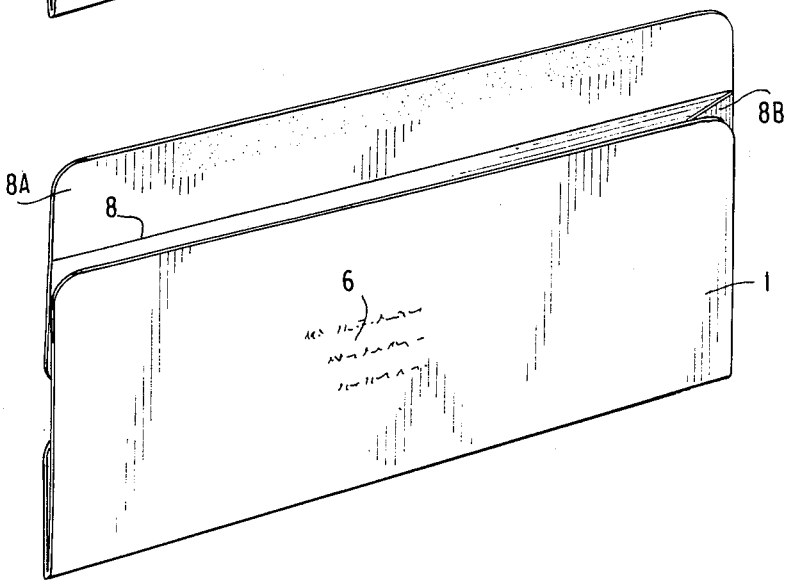
FIG. 3 is a view of the rear surface of the preferred embodiment of the present invention showing the hinged enclosing flap unfolded in the open position.

This invention which is commercially known in its preferred embodiment as a "Pull Pack", is shown on the attached drawings and discussed in detail hereinafter.

The direct mail solicitation device of the present invention has an outer wrapper 1 which is vertically formatted and preferably constructed of a heavy gauge, non-transparent paper. Optionally, outer wrapper 1 has a display window 1A in the center with a clear glassine covering. Outer wrapper 1 has an optional thumb-size notch 2 cut into the wrapper at its upper end for presentation of the inner sheet pull tab 9 adjacent the top end 2A which is open for removal of the inner sheet and reply envelope. This outer wrapper also has a hinged, adhesive coated enclosing flap 8A that has been designed with a scored flap hinge 8 that permits the inner sheet 19 and reply envelope 20 to be mechanically inserted therein. Subsequent to (1) folding the inner sheet 17 about reply envelope 20 and (2) inserting the folded, inner sheet and the reply envelope into the outer wrapper 1, the adhesive coated enclosing flap 8A is folded over and sealed to lock the reply envelope by compression into the outer wrapper. This locking prevents the inner sheet and reply envelope from falling out of the open end of the outer wrap during handling and delivery. The outer wrapper optionally comprises promotional copy 3 and 4, a return address 5, a company permit imprint 7 and the recipients, name and address 6 for delivery through the mail.

The inner sheet 19 is an elongated promotional device having first and second portions, 10A and 13. Preferably the inner sheet is printed on heavy gauge paper stock. The sheet optionally has a label or graphic element 11 positioned in the center of the first portion 10A which could show through the optional window of the outer wrapper 1A. Preferably at least one of these portions is dimensioned to fit within reply envelope 20. The second portion 13 of the inner sheet 19 is hinged to the first portion 10A by a transverse fold line 12 which is optionally perforated to facilitate separation of said first and second portions of the inner sheet.

Optionally, the inner sheet contains a pull indicator 9, which shows through the thumb notch 2 and is optionally colored. In a preferred embodiment the inner sheet contains promotional copy 10 and 15, and information for customer ordering 16, 17, and 18.

The reply envelope 20 is custom sized to precisely fit into the outer wrapper 1 and lock the inner sheet 19 into the outer wrapper when the inner sheet 19 is folded about the reply envelope and the reply envelope is compressed within the outer wrapper upon sealing the flap. This compression fit is achieved by having the width of the envelope substantially equal to the width of the outer wrapper. Optionally the reply envelope is a postage paid business reply envelope.

Like some other previously designed devices the invention can have one end of the outer wrapper open during handling. However, the present inventors are unaware of any previous open-ended interactive devices that have been approved by the U.S. Postal Service. The Postmaster at the principal U.S. Post Office in Philadelphia. Pennsylvania has approved for mailing the Pull Pack as described in its preferred embodiment. It is the novel tight fit of the present invention that allows the design to conform to U.S. Postal Service requirements.

Moreover, unlike previous designs, the internal components do not have to be hand assembled into the outer wrapper to be tight enough to stay in position during shipment. The design of the hinged flap 8A allows the return envelope 20 and the inner sheet 19 to be mechanically inserted into the outer wrapper 1 on a standard inserting machine. This aspect of the design is a critical part of the present invention because it allows the device to be produced cost effectively in a short period of time and at the high volume necessary for successful large direct mail campaigns. Typical mailings in which the Pull Pack has been used involve assembly and mailing of 300,000 to 400,000 pieces per day and an overall program over several days of 1,000,000 to 3,000,000.

Although it is known to provide an open-ended device so tight fitting that its insert will not fall out in normal handling (see U.S. Pat. No. 2,852,277), the device of U.S. Pat. No. 2,852,277 does not embody the concept of the present invention whereby the insert is chiefly held by its being folded about an envelope whereby subsequent to insertion of the folded insert and the envelope into the outer wrapper, the inserted envelope, because of its custom fit is locked by compression. The locking of the envelope upon closing and sealing the flap of the outer wrapper serves to hold the folded insert securely in place. It is this novel concept which achieves a fit so tight that it complies with postal requirements. In addition, the present invention has a design which enables cost-effective production in a short period of time even at high volume.

FIG. 8 is an end view of the inserted device of the present invention. FIG. 8 shows the reply envelope 20 nested between the first portion 10A and the second portion 13 of inner sheet 19. The adhesive coated enclosing flap 8A is not yet sealed. The outer wrapper 1 is constructed in a similar manner as conventional side seam envelopes (FIG. 9) with the following exceptions (1) Only the bottom end 8B of the outer wrapper is attached during the manufacturing process;

(2) If required for a specific package design, a large window 1 is die cut into the center of front of the sheet to display the graphic element 11 on the inner sheet;

(3) The return address 5 and permit imprint 7 are printed on the enclosing flap 8A. After the flap is closed and sealed, the mailing information 5, 6 and 7 are positioned on the back of the wrapper thus leaving its face unobstructed for use as a promotional vehicle; and (4) The tolerances of the window position on the face of the outer wrapper and the position and depth of the hinge scoring on the flap are a closer tolerance than found on conventional envelopes.

The design and construction of this wrapper allow the package to be produced and undergo insertion in the following sequence. The inner sheet 19 is received printed with perforated line 12. Perforated fold line 12 separates the first portion or information portion 10A of the inner sheet 19 from the second portion or order card 13 of inner sheet 19. The first portion 10A is folded over the second portion 13 to create a pocket for the business reply envelope 20. In this example, the inner sheet is put through a labelaire machine, a mechanical device which can automatically affix a mylar label to the face of the first portion of the sheet. Next, the reply envelope is nested into the folded pocket, and then this inner sheet assembly is placed into the feeder hopper on the mechanical inserter. The outer wrappers are placed into a second feeder hopper on the inserter. When the machine is turned on, mechanical fingers pull one inner sheet assembly out of the hopper and onto a conveyor belt. This belt moves toward the awaiting outer wrapper, which is held open by mechanical fingers with vacuum operated suction cups. The inner sheet assembly is then inserted by another set of mechanical fingers. The inserted outer wrapper is released by the suction cups and moved through a moistening device which activates the adhesive on the inside of the flap 8A. As the completed assembly moves down another conveyor, the flap is closed by a plow folder. This compresses the return envelope in the inner sheet which locks the sheet into the outer wrapper, while at the same time seals the flap to the back of the wrapper. The Pull Pack is now ready for delivery.

When the assembled Pull Pack is delivered to the prospective customer, the promotional elements have been designed to interact with the recipient in the following sequence:

(1) The recipient's attention is attracted either to the graphic element 11 displayed through the optional window 1A of the outer wrapper 1 which is positioned on the front of the inner sheet 19, or to the graphic element printed on the outer wrapper.

(2) Next, the recipient's attention is drawn to the color keyed promotional/instruction copy 10 above the window 1A. This copy is designed to further arouse the recipient's interest in the offered product or service displayed in the window. It also instructs the recipient to interact with the package by pulling the color keyed tab 9 on the inner sheet 19 which is displayed in the die cut notch 2 of the outer wrapper 1.

(3) The recipient pulls the tab 9, which instantly exposes both the additional promotional copy 10 and the graphic element 11, thereby displaying and benefits of the product or service offered.

(4) When the inner sheet 19 is fully released from the outer wrapper 1, the hinged order form 13 folds down at the transverse perforation 12. This action drops the postage paid reply envelope in front of the recipient and exposes the order form 13 with its additional promotional copy 15 and request for ordering information 16. The recipient has only to fill out the information requested (17), remove the order card from the inner sheet at the perforation 12, and insert this card into the reply envelope to complete the transaction. A toll-free ordering number 18 is also supplied for additional ordering convenience.

The adhesive on the inside of flap 8A can be any conventional adhesive means including sticky or pressure sensitive adhesive, remoistenable adhesive, etc.

Without further elaboration, it is believed that one skilled in the art can, using the preceding description, utilize the present invention to its fullest extent. The above-mentioned preferred embodiments are, therefore, to be construed as merely illustrative and not limitative of the remainder of the disclosure in any way whatsoever. The preceding examples can be repeated with similar success by substituting the generically or specifically described constituents of this invention for those specifically used in the examples. From the foregoing description, one skilled in the art to which this invention pertains can easily ascertain the essential characteristics thereof and, without departing from the spirit and scope of the present invention, can make various changes and modifications to adapt it to various usages and conditions.

What is claimed is:

1. A direct mail solicitation device comprising:

(A) an outer wrapper folded along one side edge, open at one end, closed, at the other end and having an adhesive coated flap extending along another side edge thereof for sealing the wrapper along said another side edge;

(B) an elongated inner sheet, having first and second portions, folded about a transverse fold line and disposed in said outer wrapper with the fold line adjacent the closed end of the outer wrapper with the end of at least one of said portions opposite the fold line disposed adjacent the open end of the outer wrapper; and (C) a reply envelope in said outer wrapper between said first and second portions of said inner sheet adjacent said fold line and dimensioned relative to said outer wrapper to be frictionally compressed between the side edges of said outer wrapper when said flap is sealed to said wrapper thereby locking the reply envelope and the folded sheet within said outer wrapper.

2. A direct mail solicitation device as in claim 1, wherein said wrapper has a thumb-size notch in the wrapper adjacent the open end thereof to facilitate gripping and removing the contents in the wrapper.

3. A direct mail solicitation device as in claim 1, wherein said transverse fold line between said first and second portions of the inner sheet is perforated to facilitate separation of said first and second portions and at least one of said portions is dimensioned to fit within said reply envelope.

4. A direct mail solicitation device as in claim 1, Wherein the outer wrapper is comprised of heavy gauge, non-transparent paper having a display window in the center with a clear glassine covering.

5. A direct mail solicitation device as in claim 1, wherein the outer wrapper further comprises promotional information, a return address, a company permit imprint and the recipients name and address for packages delivered through the mail.

6. A method for assembling a direct mail solicitation device comprising:

(A) folding first and second portions of an elongated sheet about a traverse fold line;

(B) locating a reply envelope having a width greater than the width of said elongated sheet between said first and second portions adjacent said fold line;

(C) inserting said sheet and reply envelope into an outer wrapper which is folded along one side edge, opened at one end, closed at the other end and having an adhesive coated flap along an other side edge which is open during insertion of the sheet and reply envelope into the outer wrapper wherein the reply envelope has a width substantially equal to the width of the outer wrapper; and (D) sealing the flap to the wrapper to compress the reply envelope between the side edges of the outer wrapper to frictionally lock the envelope in the wrapper to prevent accidental withdrawal of the sheet from the open end of the outer wrapper.

* * * * *